United States Patent [19]

Murakami et al.

[11] 4,425,702

[45] Jan. 17, 1984

[54] METHODS OF FABRICATING A MINIATURE HIGH FREQUENCY COIL ASSEMBLY OR TRANSFORMER

[75] Inventors: Hiromi Murakami, Kawagoe; Masato Suzuki, Sakado; Tutomu Suzuki, Kawagoe, all of Japan

[73] Assignee: Toko, Inc., Tokyo, Japan

[21] Appl. No.: 195,929

[22] Filed: Oct. 10, 1980

Related U.S. Application Data

[62] Division of Ser. No. 907,576, Feb. 19, 1978, Pat. No. 4,245,207.

[30] Foreign Application Priority Data

| | | | |
|---|---|---|---|
| May 20, 1977 | [JP] | Japan | 52-63844 |
| Jul. 4, 1977 | [JP] | Japan | 52-79655 |
| Jul. 4, 1977 | [JP] | Japan | 52-79656 |

[51] Int. Cl.[3] ..... H01F 7/06

[52] U.S. Cl. ..... 29/606; 29/605; 264/272.19

[58] Field of Search ..... 29/606, 602 R, 605; 264/261, 262, 272.19; 336/83, 96, 136, 205

[56] References Cited

U.S. PATENT DOCUMENTS

| | | | |
|---|---|---|---|
| 3,525,966 | 8/1970 | Wierzbinski | 336/205 |
| 4,009,459 | 2/1977 | Benson et al. | 336/96 |
| 4,149,135 | 4/1979 | Roespel et al. | 336/83 |

FOREIGN PATENT DOCUMENTS

| | | | |
|---|---|---|---|
| 1054341 | 1/1967 | United Kingdom | 336/83 |
| 1082226 | 9/1967 | United Kingdom | 336/136 |

*Primary Examiner*—Carl E. Hall
*Assistant Examiner*—P. W. Echols
*Attorney, Agent, or Firm*—Robert E. Burns; Emmanuel J. Lobato; Bruce L. Adams

[57] ABSTRACT

An external core member is mounted on a dielectric substrate. The external core member is made of a magnetic material and is formed with a through bore. A coil member is disposed on the substrate and within the through bore. An elastic material casting is formed in the through bore and about the coil member, and having a core receiving bore formed therein. The core receiving bore is arranged coaxially with the longitudinal axis of the coil member so as to extend through the coil member at its center portion. A movable core of a magnetic material is movably retained in the core receiving bore.

3 Claims, 23 Drawing Figures

METHODS OF FABRICATING A MINIATURE HIGH FREQUENCY COIL ASSEMBLY OR TRANSFORMER

This is a divisional of application Ser. No. 907,576, filed May 19, 1978 now U.S. Pat. No. 4,245,207.

BACKGROUND OF THE INVENTION

The present invention relates to a miniature high frequency (h-f) coil assembly or transformer of the kind suitable for use with a hybrid integrated circuit, more particularly to a miniature h-f coil assembly or transformer of the kind which has both a high inductance and a high Q and which has a variable inductance, and still more particularly to a method of fabricating the above coil assembly or transformer.

A h-f coil or transformer, which is used in an intermediate frequency (i-f) stage of electronics appliances such as a radio or television receiver, is required to have a considerable number of windings and to have a variable inductance. These requirements arise from the facts that (1) the inductance and the Q of a coil should have high values in the i-f range, and (2) the coil should compensate for fluctuations in circuit operation and variation between individual parts and also between fully assembled h-f coils.

Prior to a description of the present invention, reference will be made to two conventional h-f coil assemblies used in an i-f stage in connection with FIGS. 1 and 2 of the accompanying drawings. The principle of the prior art of FIG. 1 has been disclosed in U.S. Pat. Nos. 3,278,877 and 3,458,844, while the prior art of FIG. 2 has been disclosed in Japanese Utility Model application published on May 19, 1972 under the number of 47-13805. In FIG. 1, one of the prior art is schematically illustrated in an elevational cross section. A bobbin 5 is snugly received, at its lower portion, in a through bore 2 of a substrate or base 1, carrying a coil 7 between its flanges 3. The bobbin 5 is made of a dielectric or electrically insulative material such as synthetic resin, and is formed with a through bore 9. The coil 7 is electrically connected to electrodes 4 at its terminal lead wires (not shown), respectively. A threaded core or slug 11 is movably received in the through bore 9 and as a consequence the inductance of the coil 7 can be varied by turning or screwing the core 11 at either of two slots (no numerals) formed in the opposite ends of the core 11. An external magnetic core 13 is snugly mounted on the bobbin 5 in a manner to cover the same, shielding magnetic fluxes generated. The h-f coil assembly as referred to above has a sufficient space between the flanges 3, so that a considerable number of windings can be accommodated therebetween. Therefore, such a coil assembly is suitable for use in an i-f stage, in that the coil can have a high inductance and Q and at the same time a variable inductance in h-f range.

However, this coil assembly encounters a problem that it can not be miniaturized to the degree where it can be used with an integrated circuit. Furthermore, the coil assembly just described consists of many parts, and resultantly it is very difficult to assemble where the parts used in the construction thereof are very small. Hence it will thus be understood that the assembly problem is inherent since the number of parts cannot be reduced with this design. The dimensions of the coil assemly of FIG. 1 are, for example, about 10 mm both in width and in depth, and about 18 mm in height. These dimensions are too large compared with those of other parts used in a hybrid integrated circuit.

In assembling the coil element of FIG. 1, the base 1 and the hollow bobbin 5 are preformed, then, the bobbin 5 is mounted on the base 1 to which the electrodes 4 are attached. The coil 7 is wound between the flanges 3, being connected to the electrodes 4 at its lead wires, respectively. The movable core 11 is inserted into the through bore 9. Finally, the external magnetic core 13 is fixedly deposited on the semi-assembled structure.

When such a coil assembly is adapted to be used with the hybrid integrated circuit, the base 1 and the bobbin 5 should be reduced in size. In this case, however, various difficulties arise that (1) mass production tolerances when making each of the parts are difficult to hold within sufficient limits whereby manufacturing costs increase, and (2) assembly processes become complicated.

In FIG. 2, the other prior art is schematically illustrated in perspective. A substantially channel-shaped magnetic core member 15 carries a coil 19 around its center portion as shown. The coil 19 is electrically connected to two electrodes 21 which are formed on both ends of the core member 15 and which are insulated from said core member 15 by a suitable insulative film (not shown). This type of h-f coil element is of very simple configuration and as a consequence can be manufactured with ease, and, furthermore, can be reduced in size to such an extent as to be used together with a hybrid integrated circuit. However, this type of h-f coil element encounters problems that (1) the magnetic shielding is not easily provided, (2) the inductance is not variable, and (3) a high inductance and a high Q can not be obtained at an i-f range.

SUMMARY OF THE INVENTION

It is therefore a primary object of the present invention to provide an improved h-f coil assembly suitable for use with a hybrid integrated circuit, wherein a coil is embedded in an elastic material, or a thermoplastic resin such as silicone rubber or polypropylene in lieu of being wound around a bobbin.

Another object of the present invention is to provide an improved h-f coil assembly having readily adjustable inductance despite its miniaturized size.

Another object of the present invention is to provide an improved h-f coil assembly having high inductance and Q despite its miniaturized size.

Still another object of the present invention is to provide an improved h-f coil assembly easily connectable to or mountable on a hybrid integrated circuit.

Another object of the present invention is to provide an improved h-f coil assembly consisting of less parts than the conventional one.

Another object of the present invention is to provide an improved method of fabricating such an improved coil assembly.

Still another object of the present invention is to provide an improved h-f coil assembly fabricable by less processes than the conventional one.

BRIEF DESCRIPTION OF THE DRAWINGS

Additional objects as well as features and advantages of the present invention will become evident from the detailed description set forth hereinafter when considered in conjunction with the accompanying drawings, wherein like parts in each of the several figures are identified by the same reference numerals and characters and wherein.

DESCRIPTION OF THE PREFERRED EMBODIMENTS

Figure 3:
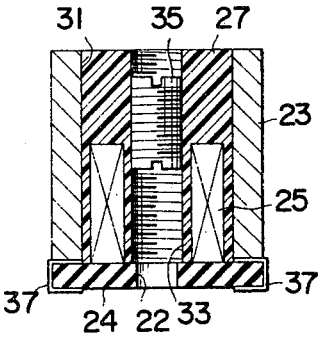
FIG. 3 is a cross sectional view of a first preferred embodiment of the present invention.

Reference is now made to FIG. 3, in which a first preferred embodiment of the present invention is illustrated. An external core member 23 is fixedly mounted on a substrate or base 24. The substrate 24 is a dielectric or electrically insulative thin plate having a thickness, for example, of from about 0.3 to 0.5 mm. The substrate 24 has a circular bore 22 at its center, and also has a plurality of electrodes 37 each formed thereon in a manner to straddle opposite rim portions or edges of the base 24, although only two electrodes 37 are shown. While the external core member 23 is made of a magnetic material such as ferrite and is of a cubic configuration or a rectangular prism having a through bore 31. The arrangement of the external core member 23 on the substrate 24 is such that the longitudinal axis of the through bore 31 is substantially perpendicular to the surface of the substrate 24. A prefabricated coil member 25 is disposed on the substrate 24 and is arranged such that the longitudinal axis thereof is alinged with the longitudinal axis of the through bore 31. The coil member 25 is electrically connected to the electrodes 37 at its lead wires (no numerals), respectively. A casting 27 of a suitable elastic material is formed within the through bore 31 of the external core member 23 and about the coil member 25 to define a core receiving bore 33 therein. This bore is, as will be appreciated from the cross sectional drawing, coaxial with and arranged to extend through the aforementioned coil 25. The elastic material includes but is not limited to a thermoplatic resin such as silicone rubber or polypropylene.

As just mentioned the core receiving bore 33 is arranged to be coaxial with the longitudinal axis of the coil member 25 and in this embodiment formed with a screw thread along the entire length thereof. A magnetic core 35 formed with a screw thread on the exterior thereof is threadedly received in said core receiving bore 33 so as to be rotatable by suitable means such as a screw driver, via the provision of means for turning it such as a slot at each end thereof (no numeral). The bore 22 of the substrate 24 is provided for turning the screw threaded core 35 from the bottom side.

Figure 4:
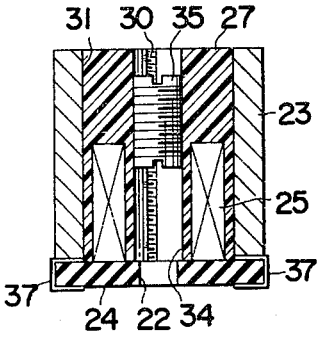
FIG. 4 is a cross sectional view of a modification of the first preferred embodiment.

FIG. 4 illustrates a modification of the first preferred embodiment of FIG. 3, wherein a core-receiving bore 34 is not originally provided with a screw thread but formed with at least three ribs 30 (only one is shown) along its length in a parallel relationship with the axis of the bore 34. The ribs 30 are tapped to provide screw threads as the core 35 is initially screwed into the bore 34.

Figure 5:
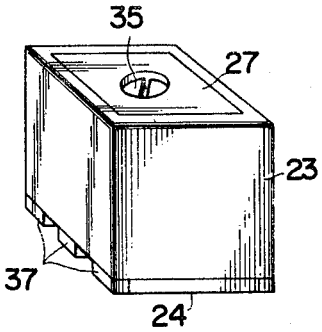
FIG. 5 is a perspective view of each of the embodiments of FIGS. 3 and 4.

FIG. 5 is an illustration in perspective of the first preferred embodiment of FIG. 3 or its modification of FIG. 4.

Figure 1:
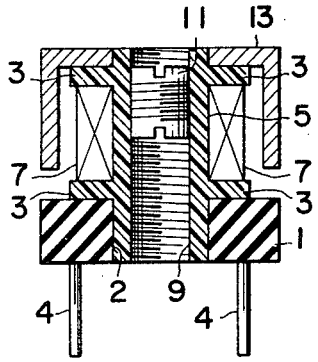
FIG. 1 PRIOR ART
FIG. 1 is a cross sectional view of a first conventional coil assembly.
Figure 2:
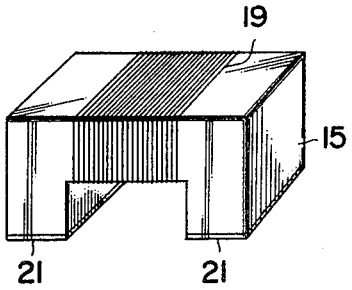
FIG. 2 PRIOR ART
FIG. 2 is a perspective view of a second conventional coil assembly.

It is understood from the above that the coil member 25 is embedded in the elastic material of the casting 27, so that the considerably bulky bobbin 5 in FIG. 1 can be omitted. Our experiments reveal that the embodiments of FIGS. 3 and 4 can be reduced in size so as to be suitable for practical use with a hybrid integrated circuit while maintaining the required high inductance and high Q in the intermediate frequency range. By way of example, the dimensions are less than about 5.5 mm in height. Inasmuch as the electrodes 37 extend to the lower surface of the substrate 24, the coil assembly can be directly deposited on a predetermined position of a hybrid integrated circuit without using the leg like electrodes shown in FIG. 1.

Figure 6:
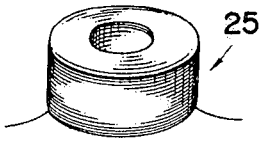
FIGS. 6 and 7 are perspective views of coils each of which can be used in the embodiments of FIGS. 3 and 4.

FIG. 6 is an illustration in perspective of the prefabricated coil member 25.

Figure 7:
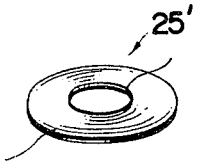

FIG. 7 is an illustration in perspective of alternative coil member 25' formed in a single-layer spirally wound on a suitable thin plate (not shown) made of plastics, for example. The single-layers are put one upon another to meet the required inductance and Q.

Figure 8:
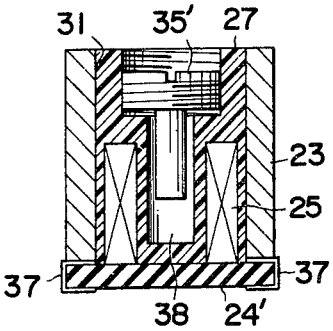
FIG. 8 is a cross sectional view of a second preferred embodiment of the present invention.

FIG. 8 illustrates a second preferred embodiment of the present invention. The main differences between the first and second embodiments are that (1) the lower portion of a core receiving bore 38 is blind and reduced in size as compared with the upper portion and is not provided with a screw thread, (2) a substrate 24' is not formed with a through bore, and (3) the magnetic core member 35' has a thread formed only on the circumferential surface of the upper larger diameter portion, and thus the lower smaller diameter portion has a smooth or even surface. The inductance of the coil assembly of FIG. 8 is varied in a similar manner as referred to in FIG. 3. This embodiment of FIG. 8 is suited for use with coils having a very small internal diameter. Such a small internal diameter makes the formation of the thread on the movable magnetic core very difficult, not to mention the difficulty of manually rotating such a small diameter core with the use of an instrument such as a screw driver.

Figure 9:
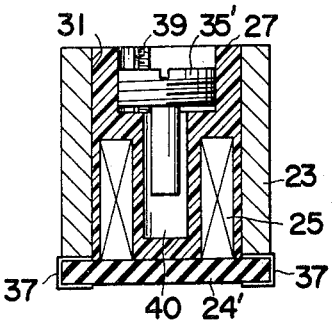
FIG. 9 is a cross sectional view of a modification of the embodiment of FIG. 8.

FIG. 9 shows a modification of the second embodiment of FIG. 8. The embodiment of FIG. 9 is of the same configuration as that of FIG. 8 except that a core receiving bore 40 is not threaded initially but formed with at least three ribs 39 (only one is shown) in parallel relationship with the axis of the bore 40. The ribs 39 each has originally an even surface and is tapped to form a thread as the core 35' is initially inserted.

In FIGS. 8 and 9, the depth of the lower smaller bore is determined considering that the desired inductance variation can be obtained.

Figure 10:
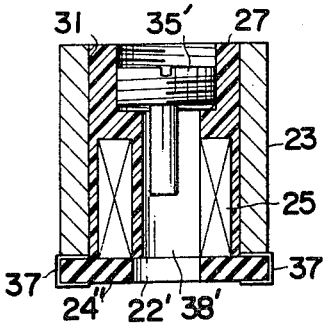
FIGS. 10 and 11 illustrate respectively modifications of FIGS. 8 and 9.
Figure 11:
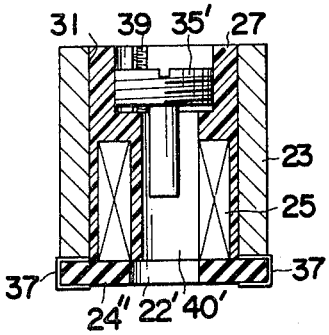

FIGS. 10 and 11 show modifications of FIGS. 8 and 9, respectively. Each of the differences therebetween is that a substrate 24" has a bore 22' communicating with a core-receiving bore 38' or 40'. The embodiments of FIGS. 10 and 11 feature that the coil 25 is not required to be prefabricated, but, is wound around a rod-like casting core (not shown) inserted into the through bore 31 from the bottom side, which will be described in detail in connection with FIGS. 22 and 23, respectively.

Figure 12:
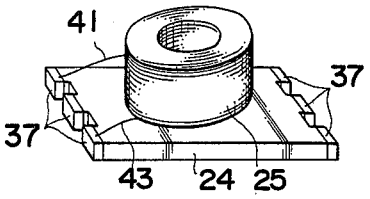
FIGS. 12, 13, and 14 illustrate a method of fabricating a coil assembly of FIG. 3.
Figure 13:
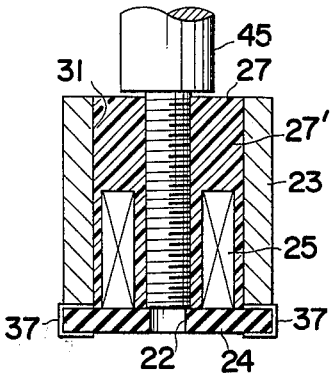
Figure 14:
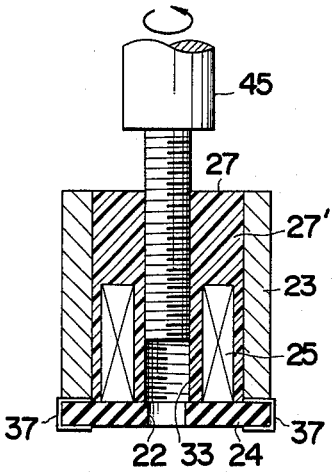

Reference is now made to FIGS. 12 through 14, wherein a method of fabricating the coil assembly of FIG. 3 is schematically illustrated. The substrate 24 has a plurality of electrodes 37, the number of which is usually six, formed on projections (no numerals). The coil member 25 is mounted on the substrate 24 so that its longitudinal axis is substantially perpendicular to the surface of the substrate 24. Lead wires 41 and 43 are then connected to the electrodes 37, respectively. The projections (no numerals) are not necessarily formed on the substrate 24, but, if provided, serve to facilitate connections of the lead wires 41 and 43 to the electrodes 37. The substrate 24 is of course not limited to square or rectangular configuration. As shown in FIG. 13, the external core member 23 is mounted on the substrate 24. The arrangement of the external core member 23 on the substrate 24 is such that the longitudinal axis of the through bore 31 is aligned with the longitudinal axis of the coil member 25. Subsequently, a casting core 45, which has a screw thread as shown, is disposed in the center bore of the coil member 25. An elastic material including but not limited to a thermoplastic material such as silicone rubber or polypropylene is cast into the through bore 31. When the elastic material 27' sets, the casting core 45 is removed by rotating same as shown by the arrow in FIG. 14. As a consequence, a bore 33 with a screw thread is produced in the casting 27. Finally, as shown in FIG. 3, the threaded core 35 is inserted into and movably retained in the bore 33.

Figure 15:
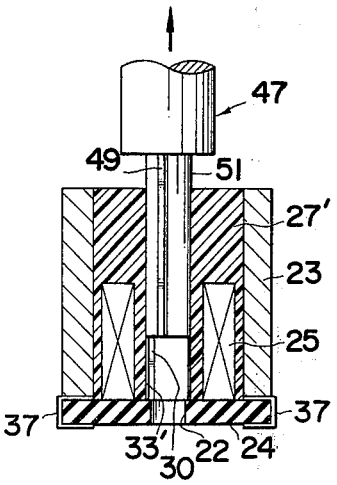
FIG. 15 illustrates in cross section a process for fabricating the coil assembly of FIG. 4.
Figure 16:
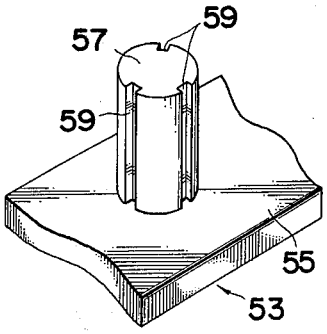
FIGS. 16–19 illustrate a method of fabricating a coil assembly similar to the modified embodiment of FIG. 4.

FIG. 15 is a view in cross section indicating a modification of a process of FIG. 14. The difference therebetween is that a round rod 51 of a casting core 47 is formed with at least three substantially equally spaced elongated slits 49 (only one is shown) on its surface and along its full length. The casting core 47 is pulled out when the elastic material sets, thus forming the through bore 33' having the at least three ribs 30. Then the threaded core 35 is screwed into the through bore 33', forming the thread on the ribs 30. The coil assembly of FIG. 4 is thus fabricated by this modified method of FIG. 15.

Figure 17:
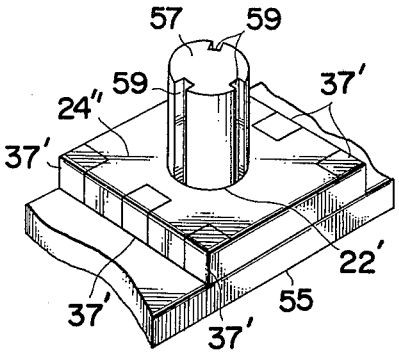
Figure 18:
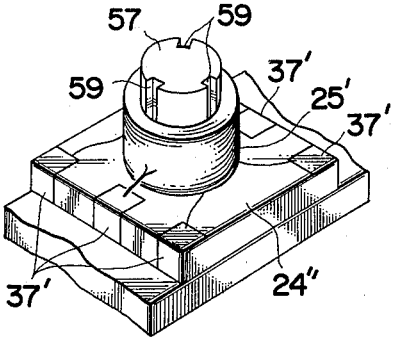

FIGS. 16 through 19 show another method of fabricating a coil assembly similar to the FIG. 4 embodiment. The substrate 24" is fixedly deposited on a flat base 55 projects perpendicularly from the flat base 55 and of a casting core member 53 such that its center bore 22' is snugly disposed about a projection 57 of the casting member 53, as shown in FIG. 17. The projection 57 is of a round rod-like configuration with at least three evenly spaced slits 59 in parallel relationship with its longitudinal axis. The substrate 24" has six electrodes 37', one of which is hidden behind the projection 57. With this arrangement, conductive wires are wound around the projection 57, forming a coil element 25', and are connected to the plurality of electrodes 37' at its lead wires (no numerals), as shown in FIG. 18. The external core member 23 is mounted on the substrate 24". Subsequently, the elastic material 27' is cast into the bore 31 of the external core member 23. When the elastic material 27' sets, the casting member 53 is removed, leaving a casting or bore similar to 34 of FIG. 4. Finally, movable core such as 35 of FIG. 4 is screwed into the produced casting, thus, tapping a screw thread into the at least three ribs (not shown) formed by the elongated slits 59. The projection 57 can be replaced with one having a screw thread (not shown), in the case of which it is understood that the through bore thus produced is formed with a thread therein. It is understood from the above that the projection 57 is used as both a casting member and a core around which the conductive wires are wound.

Figure 19:
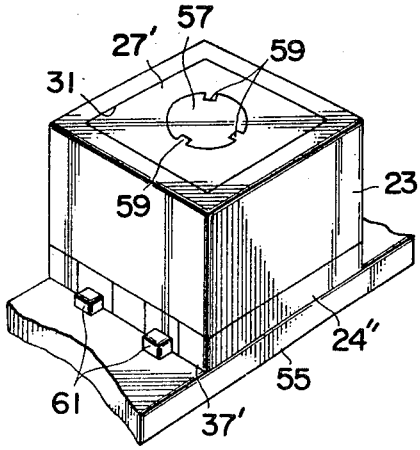

If there is a possibility that the substrate 24" will rotate undesirably around the projection 57 during the assembling, suitable stoppers 61 can be provided to prevent the rotation as shown in FIG. 19. Alternatively, such an unwanted rotation may be prohibited by making the cross sectional configuration of the substrate 24" square or elliptical, for example. In this instance, the cross sectional configuration of the bore 22' should be changed to agree with that of the projection 57.

Figure 20:
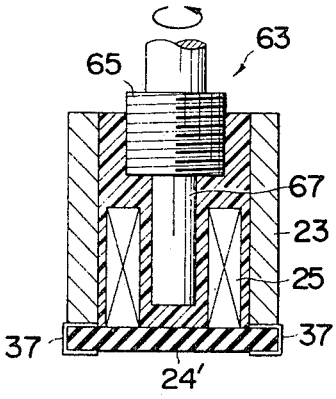
FIGS. 20 and 21 illustrate arrangements for fabricating the coil assemblies of FIGS. 8 and 9, respectively.
Figure 21:
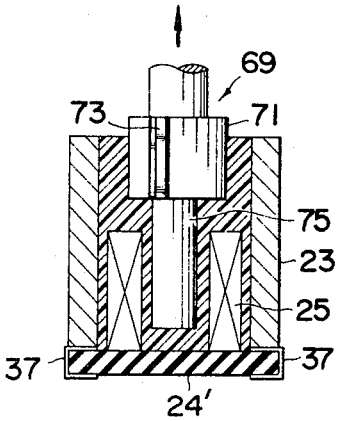

FIGS. 20 and 21 show respectively arrangements for fabricating coil assemblies as shown in FIGS. 8 and 9. These arrangements are respectively similar to those referred to in connection with FIGS. 14 and 15. A casting member 63 of FIG. 20 has a large portion 65 formed with a screw thread and a small portion 67 with an even surface. While, a casting core 69 of FIG. 21 has a large portion 71 formed with at least three ribs 73 (only one is shown) in an even spaced relationship around the circumferential surface thereof, and also has a small portion 75 with an even surface. Other steps for fabricating the coil assemblies will be omitted for clarity in that these are obvious from the foregoing descriptions.

Figure 22:
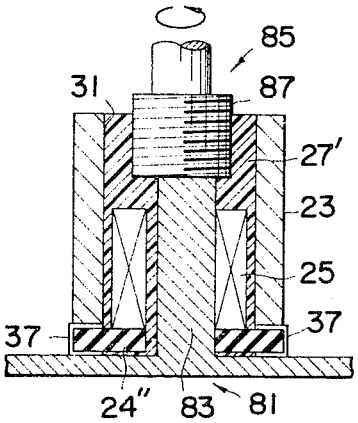
FIGS. 22 and 23 illustrate arrangements for fabricating the coil assemblies of FIGS. 10 and 11, respectively.
Figure 23:
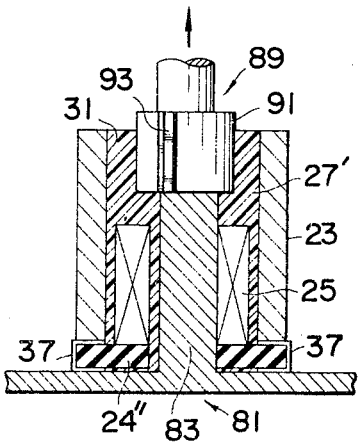

FIGS. 22 and 23 illustrate the arrangements for fabricating the coil assemblies of FIGS. 10 and 11, respectively. A casting core member 81 of FIG. 22 has a flat base and is the same as the member 53 of FIG. 16 except that a perpendicular projection 83 is shorter relative to the projection 57. After conductive wires are wound around the projection 83, another casting member 85 is deposited on the projection 83 such that two axes are aligned with each other. Then, the elastic material 27' is cast into the through bore 31 of the external core member 23. The two casting cores 81 and 85 are removed, after the elastic material 27' sets, in the same manner as referred to above. This method is suitable where the coil member 25 has a considerably small internal diameter as discussed in connection with FIG. 8. While FIG. 23 illustrates a modification of the embodiment of FIG. 22, which is the same as the former with the exception that a casting member 89 has a portion 91 with at least three evenly spaced slits 93 (only one is shown), just like the portion 71 of FIG. 21. It is apparent that when the elastic material 27' sets, the casting core 89 is pulled out and not rotated as in FIG. 22, and other casting core 81 is also removed, thus forming the core-receiving bore 40' (FIG. 11).

From the foregoing description, it will be understood that the h-f coil assembly or transformer according to the present invention can be miniaturized to the degree where it is usable with a hybrid integrated circuit, and the method thereof is considerably simple and suitable for a mass-production.

It is believed obvious that other modifications and variations of the present invention will be suggested to those skilled in the art in the light of the above teachings. It is therefore to be understood that changes may be made in the particular embodiments of the present invention described which are within the full intended scope of the present invention as defined by the appended claims.

What is claimed is:

1. A method of fabricating a high frequency coil assembly or transformer, comprising the following steps:

preparing a substrate having a plurality of electrodes and having a through bore in its center portion;

disposing the substrate on a first casting core which has a flat base and a projection projecting perpendicularly from said flat base, the arrangement of the substrate on said casting core being such that said substrate lies on said flat base and said projection extends axially through the bore thereof;

winding a coil around said projection;

disposing an external core member on said substrate circumferentially of said coil, said external core member being made of a magnetic material and having a through bore therein, the arrangement of said external core member on said substrate being such that the longitudinal axis of said through bore of said external core member is coaxial with the longitudinal axis of said projection and encloses said coil;

disposing a second casting core on said projection such that the axes of said second casting core and said projection are coaxial, said projection being dimensioned such that said second casting core is partly received in said through bore of said external core member, and said second casting core having a larger diameter than said projection;

casting a settable elastic material into said through bore of said external core member;

removing said first and second casting cores after setting of said elastic material, thereby forming a core-receiving bore in said elastic material; and inserting a movable core made of a magnetic material into said core-receiving bore of the elastic casting material.

2. A method as claimed in claim 1, wherein said second casting core has a thread along its length, and wherein said movable core has first and second portions each having a different diameter, said first portion having a screw thread along its length and having means for turning the same at its top end, and having a larger diameter than said second portion.

3. A method as claimed in claim 1, wherein said second casting core has a plurality of slits on its surface in a substantially parallel relationship with its axis whereby a plurality of ribs are produced in said core-receiving bore with said plurality of slits each initially having an even surface but being tapped to form a thread when said movable core is first screwed therein, and wherein said movable core has an external screw thread along its length.

* * * * *